US005234486A

United States Patent [19]

Choudhury et al.

[11] Patent Number: 5,234,486

[45] Date of Patent: Aug. 10, 1993

[54] METHOD FOR REMELTING REACTIVE METALS

[75] Inventors: Alok Choudhury, Püttlingen; Norbert Ludwig, Niedernberg; Harald Scholz, Rodenbach, all of Fed. Rep. of Germany

[73] Assignee: Leybold Durferrit GmbH, Cologne, Fed. Rep. of Germany

[21] Appl. No.: 924,835

[22] Filed: Aug. 4, 1992

[30] Foreign Application Priority Data

Apr. 18, 1992 [DE] Fed. Rep. of Germany ..... 4212947

[51] Int. Cl.[5] ..... C22B 4/00

[52] U.S. Cl. ..... 75/10.26; 75/10.24; 75/10.25

[58] Field of Search ..... 75/10.24–10.26

[56] References Cited

U.S. PATENT DOCUMENTS 3,868,987 3/1975 Galey ..... 75/10.24
3,989,091 11/1976 Medovar ..... 75/10.26

FOREIGN PATENT DOCUMENTS 979583 1/1965 United Kingdom .

OTHER PUBLICATIONS

DE-Z: Kammel, Roland; WInterhager, Helmut: Raffination von Metallen durch Elektroschlacke-Umschmelzen. In: Ermetall, Bd. XXI, 1968, H.9, S. 399–404.

*Primary Examiner*—Peter D. Rosenberg
*Attorney, Agent, or Firm*—Felfe & Lynch

[57] ABSTRACT

For the remelting of titanium or zirconium, the electroslag remelting method is used. To prevent any reaction of the melt with oxygen or nitrogen, the remelting is performed in an inert gas atmosphere. Fluorspar with an addition of calcium oxide is used as the slag forming substance. This calcium oxide dissolves in the fluorspar and reacts with oxygen, nitrogen and hydrogen in the titanium, so that the reactive metal is purified of these substances.

6 Claims, No Drawings

METHOD FOR REMELTING REACTIVE METALS

The invention relates to a method for remelting reactive metals and metal alloys, especially titanium and titanium alloys.

Reactive metals such as titanium or zirconium have heretofore been made of titanium or zirconium sponge pressed to form electrodes of circular cross section and then remelted by the vacuum arc remelting process (VAR) to form an ingot of circular cross section, in order to remove impurities such as oxygen, nitrogen or hydrogen. The circular cross section is necessary so that, for the sake of the necessary uniform heat distribution, the arc will everywhere be at the same distance from the margin of the crucible. An electroslag remelting method would have the advantage, on account of the uniform heat distribution resulting from the slag, that ingots could be produced in slab form, i.e., with flat sides, which is more advantageous for further processing by rolling. Heretofore, however, it has not been possible to produce high-purity reactive metals by the electroslag remelting method, because at the high temperatures that occur no slag composition could be found that would be sufficiently stable and metallurgically active during the remelting period, by which the impurities of the melting metal sponge can be removed.

The invention is addressed to the problem of developing a method for the remelting of reactive metals which can be performed with the least possible effort and will permit the production of ingots with flat sides.

This problem is solved in accordance with the invention by performing the remelting by the electroslag remelting method with an inert gas atmosphere over the slag bath, using a high-purity fluorspar as the slag forming substance without the addition of alumina, and adding at least one alkaline earth metal to the slag.

With a slag forming substance of this kind, even reactive metals can be remelted by the electroslag remelting method. Contrary to what is expected, the alkaline earth metal does not vaporize at the temperatures that occur, of more than 1600° C., since it is absorbed in dissolved form by the fluorspar-containing slag. On the other hand, alkaline earth metals are not dissolved by the reactive metals in question, nor do they react with them. Therefore the alkaline earth metals can purify the reactive metals when the latter are melted. The inert gas atmosphere prevents absorption of oxygen by the oxygen-seeking melt.

A method was tested in practice, in which calcium is added to the slag as the alkaline earth metal in the remelting of titanium as the reactive metal. In such a method the calcium purifies the molten titanium by the following reactions:

$$(Ca)+(O)Ti=(CaO)$$

$$3(Ca)+2(N)Ti=(Ca_3N_2)$$

$$(Ca)+2(H)Ti=(CaH_2).$$

The reaction products thus formed are retained by the fluorspar slag.

Since a slag formed of fluorspar alone has a low electrical resistance, an undesirably high electrical power would be needed for the remelting process. This power can be reduced by increasing the electrical resistance of the slag by adding calcium oxide to the fluorspar serving as the slag-forming substance, in accordance with an advantageous further development of the method of the invention. This calcium oxide increases the electrical resistance of the slag but, unlike the alumina commonly used to increase the resistance, it does not react with titanium.

Argon has proven advantageous as the inert gas.

If the ingots produced by the remelting are to be shaped by rolling, it is easily possible to produce ingots with flat sides, for example of a square cross section, directly in the remelting by using a crucible with flat sides for the remelting.

To prevent any entry of air into the furnace chamber and reliably assure an inert gas atmosphere above the slag bath, it is advantageous to conduct the process in a closed furnace system with an inert gas under an overpressure.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Method for remelting reactive metals and metal alloys, comprising: performing remelting by an electroslag remelting process with an inert gas atmosphere over a slag bath including using fluorspar without the addition of alumina as a slag-forming substance, and including adding at least one alkaline earth metal in its elemental state to the slag.

2. Method according to claim 1, which includes remelting titanium as a reactive metal including adding calcium to slag as alkaline earth metal.

3. Method according to claim 1, in which adding calcium to slag includes adding calcium oxide to fluorspar serving as slag-forming substance.

4. Method according to claim 1, which includes using argon as inert gas.

5. Method according to claim 1, which includes using a crucible with flat side surfaces as a crucible.

6. Method according to claim 1, in which performing remelting the reactive or metal alloy by the electroslag remelting process is in a closed furnace system with inert gas under an overpressure.

* * * * *